US008657589B2

(12) United States Patent
Stein et al.

(10) Patent No.: US 8,657,589 B2
(45) Date of Patent: Feb. 25, 2014

(54) OPERATING METHOD FOR A HYDRAULIC MACHINE

(75) Inventors: Uwe Bernhard Pascal Stein, Edinburgh (GB); Niall James Caldwell, Edinburgh (GB); William Hugh Salvin Rampen, Edinburgh (GB)

(73) Assignee: Artemis Intelligent Power Limited, Edinburgh (GB)

( * ) Notice: Subject to any disclaimer, the term of this patent is extended or adjusted under 35 U.S.C. 154(b) by 704 days.

(21) Appl. No.: 12/161,457

(22) PCT Filed: Feb. 2, 2007

(86) PCT No.: PCT/GB2007/000367

§ 371 (c)(1), (2), (4) Date: Jul. 18, 2008

(87) PCT Pub. No.: WO2007/088380

PCT Pub. Date: Aug. 9, 2007

(65) Prior Publication Data

US 2010/0243067 A1 Sep. 30, 2010

(30) Foreign Application Priority Data

Feb. 2, 2006 (GB) ..... 0602111.7

(51) Int. Cl.
*F04B 27/08* (2006.01)
*F04B 1/26* (2006.01)

(52) U.S. Cl.
USPC ..... 417/270; 417/505; 417/506; 417/53; 91/482

(58) Field of Classification Search
USPC ..... 417/53, 270, 299, 505, 506; 91/482
See application file for complete search history.

(56) References Cited

U.S. PATENT DOCUMENTS 1,898,228 A * 2/1933 Thompson ..... 361/116
3,679,328 A 7/1972 Cattanach (Continued)

FOREIGN PATENT DOCUMENTS

EP 0494236 7/1992
EP 1319836 6/2003

(Continued)

OTHER PUBLICATIONS

Introduction to Fluid Power, James Johnson, Cengage Learning, 2001, Section 3.7, ISBN Cavitation and Aeration , 0766823652, 9780766823655.*

(Continued)

*Primary Examiner* — Devon Kramer
*Assistant Examiner* — Thomas Fink
(74) *Attorney, Agent, or Firm* — Stephen H. Eland; Dann, Dorfman, Herrell & Skillman, P.C.

(57) ABSTRACT

A hydraulic machine has at least one working chamber (11) of cyclically changing volume, and low-pressure and high pressure valves (15, 13) to control the connection of each of the at least one working chambers to low-pressure and high-pressure lines (16, 14) respectively. A method of operating the machine includes holding the low-pressure valve means (15) closed during at least an entire cycle of the chamber (11), starting at minimum chamber volume, such that gas dissolved in liquid in the chamber is released therefrom during an expansion of the chamber volume and re-dissolved during a reduction thereof.

8 Claims, 1 Drawing Sheet

(56) References Cited

U.S. PATENT DOCUMENTS

| | | | | |
|---|---|---|---|---|
| 3,712,758 | A | 1/1973 | Lech et al. | |
| 5,456,581 | A | 10/1995 | Jokela et al. | |
| 6,575,710 | B2 * | 6/2003 | Wallis | 417/298 |
| 2005/0254980 | A1 * | 11/2005 | Hedman | 417/503 |

FOREIGN PATENT DOCUMENTS

| | | |
|---|---|---|
| JP | 2004108371 | 4/2004 |
| WO | 02/16770 | 2/2002 |
| WO | 2004/025122 | 3/2004 |
| WO | WO-2004025122 A1 * | 5/2004 ..... F04B 49/06 |

OTHER PUBLICATIONS

NCFP 105-10.1 Design of a Virtually Variable Displacement Pump/Motor, by Nieling et al., University of Wisconsin-Madison, pp. 323-335, Mar. 2005.*

Practical Hydraulic Systems: Operation and Troubleshooting for Engineers and Technicians, by Doddannavar, Published Apr. 2005, p. 100.* http://www.toolingu.com/definition-570230-36657-pilot-operated-check-valve.html, Published Dec. 2012.*

* cited by examiner

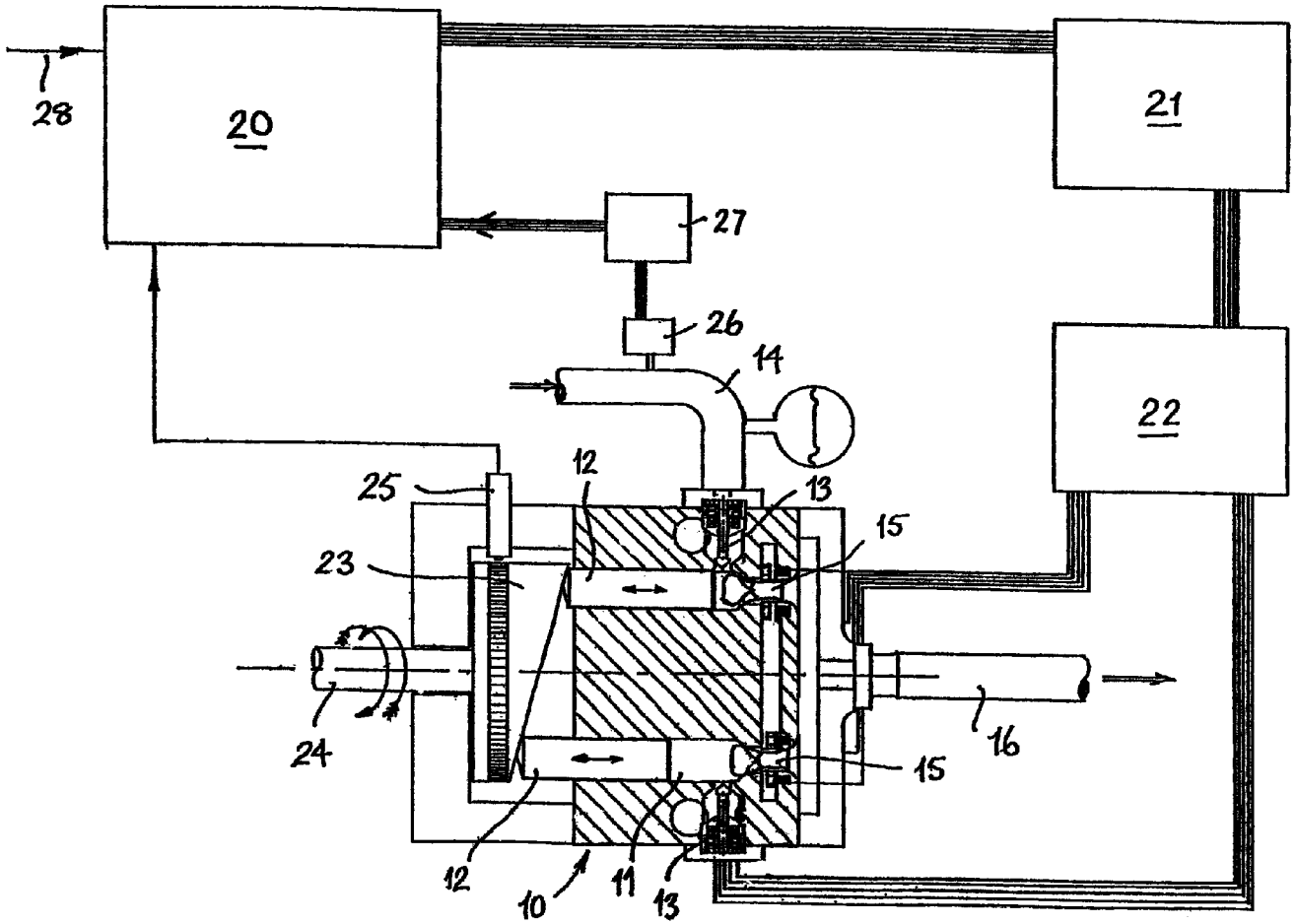
21
22
20
28
27
26
14
13
15
15
16
13
11
10
12
12
25
23
24

OPERATING METHOD FOR A HYDRAULIC MACHINE

BACKGROUND TO THE INVENTION

This invention relates to a hydraulic machine, i.e. a motor or pump, having at least one working chamber of cyclically changing volume and valve means to control the connection of the or each chamber to low- and high-pressure manifolds. The invention also relates to a method of operating the machine.

The invention has particular reference to machines where the at least one working chamber comprises a cylinder in which a piston is arranged to reciprocate, but its use with at least one chamber delimited by a flexible diaphragm or a rotary piston is not ruled out.

With most hydraulic machines the fluid chambers undergo cyclical variations in volume following a sinusoidal function. It is known from EP-A-0361927 that a chamber can be left to idle by holding an electromagnetically actuated valve, between the working chamber and the low-pressure source, in the open condition. Thus the output is varied through the through the action of first filling each working chamber with liquid, then deciding whether to reject the liquid back to the low-pressure source or to pump it at pressure to the output manifold. Pumping the liquid back to the low-pressure source means that a very small amount of power needs to be expended, during the time that a working chamber is idle, whilst still allowing the working chambers to become productive with a minimum latency period.

It has become common practice to regulate the flow of piston pumps by closing the intake means part way through the stroke such that the entrained air in the liquid expands and forms bubbles in the liquid during the closed expansion, which occurs below atmospheric pressure. On compression, this volume of air is first compressed before the liquid component of the cylinder reaches the pressure required to open the face-seating non-return valve connected to the high-pressure manifold. It is only once pressure and consequently density of the liquid in the working chamber has increased sufficiently and the valve has opened that delivery to the high-pressure manifold can commence. If the piston has significant velocity when the gas bubble volume nears zero, then the rapid pressure rise, that accompanies this change of compliance, creates an impulsive rise in stress throughout the machine, which results in both audible and fluid-borne noise.

SUMMARY OF THE INVENTION

The invention seeks to provide an alternative method of controlling the output of a hydraulic machine by means of idle strokes, not experiencing the "breathing loss" associated with pumping the liquid back to the low-pressure source.

The invention provides a method of operating a hydraulic machine having at least one working chamber of cyclically changing volume, and low- and high-pressure valve means to control the connection of the or each chamber to low- and high-pressure lines respectively, the method including holding the low-pressure valve means closed during at least an entire cycle of the chamber, starting at minimum chamber volume, such that gas dissolved in liquid in the chamber is released therefrom during an expansion of the chamber volume and re-dissolved during a reduction thereof.

The liquid typically comprises oil and the gas typically comprises air. It is thus possible to control the displacement of the pump described in EP-A-0361927 by means of air release idle strokes rather than the full flow ones described therein.

To initiate an idle stroke in this mode, the controller must ensure that the induction valve is closed at top-dead-centre, where the chamber comprises a cylinder with a reciprocating piston. The low-pressure valve is then maintained in a closed state throughout the subsequent revolution of the crankshaft, or cycle of the working volume, such that an air release bubble forms during the expansion and closes again upon the compression stroke. The next opportunity to change the state of the working chamber comes at the following minimum volume or top-dead-centre position, when the valve means can be released to open so that the chamber can fill with liquid during a subsequent intake part of the cycle. The low-pressure valve means may comprise an electromagnetically-operated valve, which may be activated, first at full current, to pull the valve into the closed position, the current then being modulated to hold it there.

The invention also provides a hydraulic machine having at least one working chamber of cyclically changing volume, low- and high-pressure valve means to control the connection of the or each chamber to low- and high-pressure lines respectively, and control means for holding the low-pressure valve means closed during at least an entire cycle of the chamber, starting at minimum chamber volume, such that gas dissolved in liquid in the chamber is released therefrom during an expansion of the chamber volume and re-dissolved during a reduction thereof.

The machine may essentially be the same as that of EP-A-0361927 but with a differently-configured control means.

BRIEF DESCRIPTION OF THE DRAWING

A particular embodiment of the invention will now be described in more detail, by way of example only, and with reference to the accompanying drawing, the single FIGURE of which schematically shows a hydraulic machine according to the invention.

DETAILED DESCRIPTION OF PARTICULAR EMBODIMENT

A multi-piston hydraulic machine according to the invention is shown in schematic section in the drawing. In the side wall of each cylinder 11 is a passive high-pressure poppet check valve 13 communicating with a high-pressure manifold 14 and in the end wall of each cylinder is a low-pressure poppet valve 15 communicating with a low-pressure manifold 16. The poppet valve 15 is an active electromagnetic valves controlled electrically by a microprocessor controller 20 feeding control signals, via optoisolators 21, to valve-driving semiconductors 22. Note that valve 15 needs to be actively controlled but valve 13 is a passive device In a motoring mode, pistons 12 act on a drive cam 23 fast to an output shaft 24 and in a pumping mode the pistons 12 are driven by the cam 23, the position of the cam 23 being sensed by position sensing means such as an encoder 25.

The controller 20 receives inputs from the encoder 25, a pressure transducer 26 (via an analogue to digital converter 27) and via a line 28 to which a desired output speed demand signal can be applied.

The poppet valves 13, 15 seal the respective cylinders 11 from the respective manifolds 14, 16 by engagement of an annular valve part with an annular valve seat, a solenoid being provided to magnetically move the valve part of poppet valve 15 relative to its seat by reacting with ferromagnetic material on the said poppet valve, each said poppet valve having a stem and an enlarged head, the annular valve part being provided on the head and the ferromagnetic material being provided on the stem.

When an air-release idling stroke is required, the controller operates to close one of the low-pressure valves 15 by top-dead centre position of the associated piston, the associated high-pressure valve 13 also being closed at this position. The valves are maintained closed through an entire cycle of the cylinder, during which air is drawn out of the fluid in the cylinder during the expansion stroke and re-dissolves during the compression stroke.

The air release disabling technique gives several benefits. Firstly, the breathing loss through the valve is eliminated on an idle stroke. This equates to saving a substantial amount of power and cooling load on a large machine. Secondly, the intake valve is not subjected to high flow rates on the discharge portion of the idle stroke which would tend to unseat it from the valve latch if the oil was very cold and viscous. Thirdly, the valves can be sized for active strokes rather than for minimizing power dissipation during idle ones.

In cold operation, the air-release method of the invention can be used to control displacement primarily to avoid the de-latching issue created by attempting to pump very viscous oil through the low-pressure valve in the reverse direction.

It has been found that heat generated by the fact that the air release bubble takes a finite time to be compressed does not damage the working fluid over time. The air bubbles are properly absorbed into the liquid during the pressurised portion of the cycle, and do not generate foam when the liquid is returned to the low-pressure line.

In WO2004/025122 we described five modes of operating a fluid-working machine, namely full stroke pumping, part stroke pumping, full stroke motoring, part stroke motoring, and idling. The invention provides a sixth mode, effectively one to be used to hibernate a cylinder to reduce its parasitic loss.

It can be used in conjunction with the other modes and would be selected if the output of the cylinder is not foreseen to be needed within the next revolution or two—a period of known part-load operation. It can also be used if the machine is going into overspeed, since the closed intake valves cannot be pushed closed by high-velocity fluid as they would in a normal idle stroke situation. Overspeed is defined by a combination of shaft speed and fluid viscosity—if the fluid is very cold it is possible to lose control of idling cylinders at much lower shaft speeds.

All forms of the verb "to comprise" used in this specification should be understood as forms of the verbs "to consist of" and/or "to include".

The invention claimed is:

1. A method of operating a hydraulic machine having at least one working chamber of cyclically changing volume, and a low-pressure valve to control a connection of each of the at least one working chamber to a low-pressure line, said low-pressure valve being an electromagnetically controlled valve that is open in its passive state, and a passive high-pressure check valve to control a connection of each of the at least one working chambers to a high-pressure line that is separate from said connection to the low-pressure line, the machine having (1) a normal idle mode, in which fluid at low pressure flows into and out of the working chamber via the low-pressure valve, (2) a working mode, in which the cylinder delivers fluid from the low-pressure line to the high-pressure line or vice-versa, and (3) a hibernation mode in which the low-pressure valve is held closed during expansion and contraction of the working cylinder, the hibernation mode being selected if it is foreseen that the working chamber will not be required to provide an output during two cycles of the chamber and, in the hibernation mode, the low-pressure valve being held closed during said two cycles, starting at minimum chamber volume, releasing air dissolved in liquid in the chamber from the liquid during expansions of the chamber volume and redissolving the air in the liquid during reductions in the chamber volume, wherein the selection of the hibernation mode is made based on a combination of a shaft speed of the machine and a viscosity of the liquid.

2. A method according to claim 1, wherein the low-pressure valve is released to open at a following minimum chamber volume position.

3. A method according to claim 1, wherein the low-pressure valve comprises an electromagnetically-operated valve.

4. A method according to claim 3, wherein the low-pressure valve is activated, first at full current, to pull the valve into the closed position, the current then being modulated to hold it there.

5. A hydraulic machine having at least one working chamber of cyclically changing volume, a low-pressure valve to control a connection of each of the at least one working chamber to a low-pressure line, said low-pressure valve being an electromagnetically controlled valve that is open in its passive state, and a passive high-pressure valve to control a connection of each of the at least one working chambers to a high-pressure line that is separate from said connection to the low-pressure line, and a controller arranged to foresee that the working chamber will not be required to provide an output during two cycles of the chamber and to select a hibernation mode in which the low-pressure valve is held closed during said two cycles, starting at minimum chamber volume, so as to release air dissolved in liquid in the chamber from the liquid during expansions of the chamber volume and to redissolve the air in the liquid during reductions in the chamber volume , the selection of the hibernation mode being made based on a combination of a shaft speed of the machine and a viscosity of the liquid.

6. A machine according to claim 5, wherein the controller is arranged to release the low-pressure valve means to open at a following minimum chamber volume position.

7. A machine according to claim 5, wherein the low-pressure valve comprises an electromagnetically-operated valve.

8. A machine according to claim 5, having six selectable modes of operation, namely full stroke pumping, part stroke pumping, full stroke motoring, part stroke motoring, idling, and the hibernation mode in which the low-pressure valve is held closed during two cycles of the chamber.

* * * * *

UNITED STATES PATENT AND TRADEMARK OFFICE

CERTIFICATE OF CORRECTION

PATENT NO. : 8,657,589 B2
APPLICATION NO. : 12/161457
DATED : February 25, 2014
INVENTOR(S) : Uwe Stein et al.

It is certified that error appears in the above-identified patent and that said Letters Patent is hereby corrected as shown below:

In the Specification

Column 2, line 43, "A multi-piston hydraulic machine according"
should read -- A multi-piston hydraulic machine 10 according --;

Column 3, line 47, "All forms of the verb "to comprise" used in this specification should be understood as forms of the verbs "to consist of" and/or "to include" should be deleted.

Signed and Sealed this
Sixteenth Day of September, 2014

Michelle K. Lee

Michelle K. Lee
*Deputy Director of the United States Patent and Trademark Office*